US006543966B2

(12) United States Patent
White

(10) Patent No.: US 6,543,966 B2
(45) Date of Patent: Apr. 8, 2003

(54) DRIVE SYSTEM FOR INSERTING AND EXTRACTING ELONGATE MEMBERS INTO THE EARTH

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 09/956,628

(22) Filed: Sep. 19, 2001

(65) Prior Publication Data

US 2002/0098044 A1 Jul. 25, 2002

Related U.S. Application Data

(63) Continuation of application No. 09/415,042, filed on Oct. 7, 1999, now abandoned, which is a continuation-in-part of application No. 08/900,481, filed on Jul. 25, 1997, now Pat. No. 6,039,508.

(60) Provisional application No. 60/122,151, filed on Feb. 26, 1999.

(51) Int. Cl.[7] ..... E02D 7/00; E02D 7/26

(52) U.S. Cl. ..... 405/232; 405/50; 254/95; 175/55; 175/56

(58) Field of Search ..... 405/50, 198, 232; 254/95, 97; 175/19, 55, 56, 162; 166/71, 77.1

(56) References Cited

U.S. PATENT DOCUMENTS

| | | | |
|---|---|---|---|
| 628,962 | A | 7/1899 | Speer |
| 1,288,989 | A | 12/1918 | Rees |
| 1,322,470 | A | 11/1919 | Schenk |
| 1,654,093 | A | 12/1927 | Reid |
| 1,903,555 | A | 4/1933 | Robertson |
| 2,577,252 | A | 12/1951 | Kjellman |
| 2,952,132 | A | 9/1960 | Urban |
| 3,172,485 | A | 3/1965 | Spannhake et al. |
| 3,300,987 | A | 1/1967 | Maeda |
| 3,313,376 | A | 4/1967 | Holland, Sr. |
| 3,381,422 | A | 5/1968 | Olson |
| 3,391,435 | A | 7/1968 | Lebelle |

(List continued on next page.)

FOREIGN PATENT DOCUMENTS

| | | |
|---|---|---|
| EP | 0172960 A1 | 3/1986 |
| EP | 84305926.2 | 3/1986 |
| EP | 526743 A1 | 2/1993 |
| EP | 0526743 B1 | 8/1995 |

(List continued on next page.)

OTHER PUBLICATIONS

A series of photographs identified by reference numbers APE01147 through APE01159 (undated).

Japanese language brochure entitled "Castle Board Drain Method", 1978.

(List continued on next page.)

*Primary Examiner*—Jong-Suk (James) Lee
(74) *Attorney, Agent, or Firm*—Michael R. Schacht; Schacht Law Office, Inc.

(57) ABSTRACT

A drive system for elongate members comprising a drive plate, a support system, an insertion housing, at least one drive gear, and a vibratory system. The suppression system resiliently opposes relative movement between the support plate and the insertion housing. The drive gear displaces the elongate member along its longitudinal axis. The vibratory forces are transmitted to the elongate member through the at least one drive gear. The drive gear and the vibratory system simultaneously crowd and vibrate the elongate member into the ground.

16 Claims, 8 Drawing Sheets

U.S. PATENT DOCUMENTS

| | | | | | |
|---|---|---|---|---|---|
| 3,394,766 | A | | 7/1968 | Lebelle | |
| 3,577,645 | A | * | 5/1971 | Zurawski | 33/209 |
| 3,684,037 | A | | 8/1972 | Bodine | |
| 3,711,161 | A | | 1/1973 | Proctor et al. | |
| 3,871,617 | A | | 3/1975 | Majima | |
| 3,874,244 | A | | 4/1975 | Rasmussen et al. | |
| 3,891,186 | A | | 6/1975 | Thorsell | |
| 3,907,042 | A | | 9/1975 | Halwas et al. | |
| 3,952,796 | A | * | 4/1976 | Larson | 165/40 |
| 4,082,361 | A | | 4/1978 | Lanfermann | |
| 4,155,600 | A | | 5/1979 | Lanfermann et al. | |
| 4,166,508 | A | | 9/1979 | van den Berg | |
| 4,195,698 | A | | 4/1980 | Nakagawasai | |
| 4,428,699 | A | | 1/1984 | Juhola | |
| 4,455,105 | A | | 6/1984 | Juhola | |
| 4,537,527 | A | | 8/1985 | Juhola et al. | |
| 4,547,110 | A | * | 10/1985 | Davidson | 414/22 |
| 4,553,443 | A | | 11/1985 | Rossfelder et al. | |
| 4,601,615 | A | | 7/1986 | Cavalli | |
| 4,627,768 | A | | 12/1986 | Thomas et al. | |
| 4,735,270 | A | | 4/1988 | Fenyvesi | |
| 4,755,080 | A | | 7/1988 | Cortlever et al. | |
| 4,813,814 | A | | 3/1989 | Shibuta et al. | |
| 4,863,312 | A | | 9/1989 | Cavalli | |
| 5,117,925 | A | | 6/1992 | White | |
| 5,213,449 | A | | 5/1993 | Morris | |
| 5,263,544 | A | | 11/1993 | White | |
| 5,281,775 | A | | 1/1994 | Gremillion | |
| 5,343,002 | A | | 8/1994 | Gremillion | |
| 5,355,964 | A | | 10/1994 | White | |
| 5,439,326 | A | | 8/1995 | Goughnour et al. | |
| 5,544,979 | A | | 8/1996 | White | |
| 5,609,380 | A | | 3/1997 | White | |
| 5,658,091 | A | | 8/1997 | Goughnour et al. | |
| 5,811,741 | A | | 9/1998 | Coast et al. | |
| 6,129,159 | A | * | 10/2000 | Scott et al. | 175/55 |
| 6,234,260 | B1 | | 5/2001 | Coast et al. | |
| 6,360,829 | B1 | * | 3/2002 | Naber et al. | 175/20 |

FOREIGN PATENT DOCUMENTS

| | | | | |
|---|---|---|---|---|
| FR | 838717 | | 3/1939 | |
| FR | 2560247 | | 2/1984 | |
| GB | 2003769 | A | 8/1978 | |
| GB | 2023496 | A | 1/1980 | |
| GB | 2043755 | * | 10/1980 | 405/232 |
| GB | 2028902 | B | 8/1982 | |
| KR | 16944/1992 | | 9/1992 | |
| NL | 42349 | | 1/1938 | |
| NL | 65252 | | 2/1950 | |
| NL | 7710385 | | 9/1977 | |
| NL | 7707303 | | 1/1979 | |
| NL | 7805153 | | 11/1979 | |
| RU | 1027357 | A | 7/1983 | |
| WO | WO87/07673 | | 12/1987 | |
| WO | WO88/05843 | | 8/1988 | |

OTHER PUBLICATIONS

"The 1st Report on the Treatment of Soft Foundation in Juck Hyun Industrial Site" (Ref. Nos. APE00854 through APE00856), (undated).

Schematic drawings identified by Ref. Nos. APE01038, APE01039, and APE0339, (undated).

A report identifying systems for driving mandrels carrying wick drain material into the earth, identified by Ref. Nos. APE0510 through APE0536, (undated).

Korean language document identified by reference numbers APE00864 through APE00891, (undated).

US Patent Application Publication, 09/754,648 (US 2001/0002230 A1), May 31, 2001.

* cited by examiner 454
458
450
550
554
448
428
464
420
462
430
422
426
456
548
478
424
444
544
552
546
556
432
442
446
560
558
460
520
522
436
482
472
470
438
540
542
536
480
502
500
434
A
496
562

DRIVE SYSTEM FOR INSERTING AND EXTRACTING ELONGATE MEMBERS INTO THE EARTH

RELATED APPLICATIONS

This is a continuation of U.S. patent application Ser. No. 09/415,042 filed on Oct. 7, 1999, abandoned which is a continuation-in-part of U.S. patent application Ser. No. 08/900,481, which was filed on Jul. 25, 1997, now U.S. Pat. No. 6,039,508, and also claims priority of U.S. Provisional Application No. 60/122,151, which was filed on Feb. 26, 1999.

TECHNICAL FIELD

The present invention relates to methods and apparatus for inserting into the earth and extracting from the earth elongate members and, more particularly, to apparatus and methods for inserting wick drain material into the earth.

BACKGROUND OF THE INVENTION

For certain construction projects, elongate members such as piles, anchor members, caissons, and mandrels for inserting wick drain material must be placed into and in some cases withdrawn from the earth. It is well-known that, in many cases, such rigid members may be driven into and withdrawn from the earth without prior excavation.

The present invention is particularly advantageous when employed to insert a mandrel carrying wick drain material into the earth, and that application will be described in detail herein. However, the present invention may have broader application to the insertion into and removal from the ground of other elongate members such as piles, anchor members, and caissons, especially when these members must be driven at an angle with respect to horizontal. Accordingly, the scope of the present invention should be determined by the scope of the claims appended hereto and not the following detailed description.

Because wick drain material is flexible, it cannot be directly driven into the earth. Instead, it is normally placed within a rigid mandrel that is driven into the earth. Once the mandrel and wick drain material have been driven into the earth, the mandrel alone is removed from the earth, leaving the wick drain material in place. The wick drain material that is left in place wicks moisture in its vicinity to the surface to stabilize the ground at that point.

Two basic systems are employed to drive mandrels into and remove mandrels from the earth. A first system is referred to as a top drive system and engages the upper end of the mandrel to insert the mandrel into the earth. In a top drive system, the upper end of the mandrel is securely attached to the drive system and forced downward or upward to insert the mandrel into or remove the mandrel from the ground. The upper end of the mandrel may also be vibrated by a vibratory drive means and/or crowded by a chain or cable drive means to cause the mandrel to penetrate the earth.

The primary disadvantage with the top drive system is that they require a substantial boom structure to support the mandrel and associated drive means. The requirement of a large and heavy boom structure limits the length of the mandrel that may be driven by a top drive system. Further, as the ground into which the wick drain material is to be inserted may be wet and unstable, the ground may not be sufficiently stable to support the required boom structure. Top drive systems thus may be inappropriate in certain situations.

A second system for inserting and removing mandrels engages the bottom end of the mandrel and will be referred to herein as a bottom drive system. A bottom drive system is not attached to any one point on the mandrel; instead, rotating roller surfaces and/or gear teeth engage the mandrel in a manner that displaces the mandrel along its axis to drive it into the ground.

Bottom drive systems require a boom sufficient to support only the mandrel; the boom for a bottom drive system may thus be significantly lighter than that for a top drive system, which alleviates some of the problems associated with large booms.

However, the primary disadvantage with known bottom drive systems is that they rely entirely on the roller or gear drive system for insertion and removal of the mandrel. Bottom drive systems do not have the benefit of a vibratory device for situations in which the mandrel becomes stuck due to soil conditions.

Accordingly, an important object of the present invention is to provide improved apparatus and methods for driving elongate members into and removing elongate members from the ground.

RELATED ART

U.S. Pat. No. 5,213,449 to Morris shows, and USSR Patent No. SU 1027357 appears to show, bottom drive devices for driving a mandrel into the ground. The Morris patent discloses a gear dive system and the USSR patent appears to show a roller drive system.

Top drive wick drain inserters are disclosed in U.S. Pat. No. 3,891,186 to Thorsell, U.S. Pat. No. 4,166,508 to van den Berg, U.S. Pat. No. 4,755,080 to Cortlever et al., Dutch Pat. No. 65252, Dutch Pat. No. 7805153, and Dutch Pat. No. 7,707,303.

The Thorsell patent employs a chain attached to the top of a wick drain mandrel to crowd the mandrel into the ground.

The van den Berg patent employs a two-part mandrel, with the two parts being wound around rollers and crowded into the ground by unwinding the rollers.

The Cortlever et al. patent discloses a cable connected to the upper end of the mandrel and a hydraulic system for displacing the cable to drive or crowd the mandrel into the ground.

The Dutch '252 and '153 patents appear to employ a chain to drive or crowd a mandrel into the ground.

In the Dutch '703 patent, a vibratory device appears to be fixed to the top end of the mandrel to drive the mandrel into the ground.

Shown in U.S. Pat. Nos. 5,117,544 and 5,117,925 issued to the Applicant are vibratory devices for driving piles into the earth. These patents disclose placing the vibratory device on top of the pile to be driven and vibrating the pile along its axis; the combination of the vibratory forces along the axis of the pile and the weight of the pile and vibratory device drives the pile into the ground. Caissons may be driven into the ground in the same manner.

SUMMARY OF THE INVENTION

The present invention is a drive system for inserting an elongate member into the ground. The drive system comprises a drive plate, a support system, an insertion housing, at least one drive gear, and a vibratory system for creating vibratory forces. The support system that engages the ground and supports the support plate at a substantially fixed height above a desired location. The suppression system is operatively connected between the support plate and the insertion housing to support the insertion housing above the desired location and resiliently oppose relative movement between the support plate and the insertion housing. The at least one drive gear is mounted to the insertion housing and engages the elongate member such that rotation of the drive gear displaces the elongate member along its longitudinal axis. The vibratory system is mounted to the insertion housing such that the vibratory forces are transmitted to the elongate member through the at least one drive gear. Rotation of the drive gear crowds the elongate member into the ground. Operation of the vibratory system vibrates the elongate member into the ground. Rotation of the drive gear and operation of the vibratory system together crowds and vibrates the elongate member into the ground.

DETAILED DESCRIPTION OF THE INVENTION

1. First Embodiment

Figure 1:
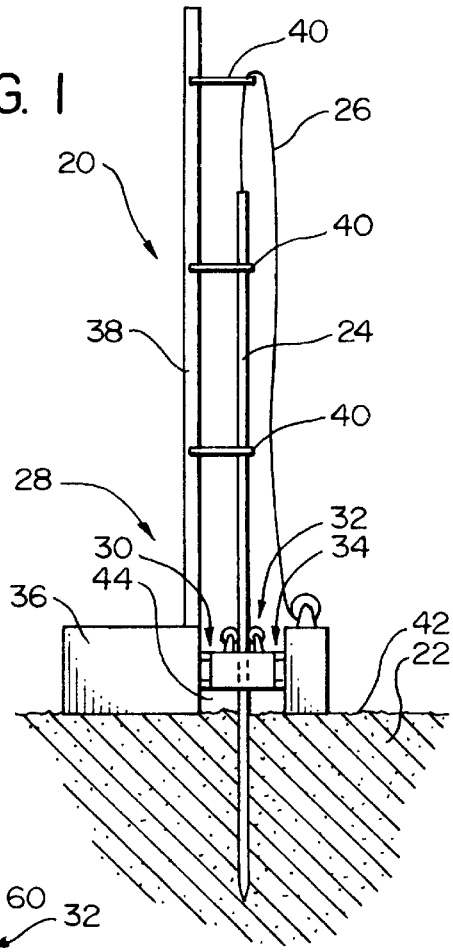
FIG. 1 is a side plan view of a first elongate member insertion/removal system that is constructed in accordance with the principles of the present invention.

Turning now to the drawing, depicted at 20 in FIG. 1 is an elongate member insertion/withdrawal system constructed in accordance with, and embodying, the principles of the present invention. The system 20 is designed to insert into and remove from the ground 22 a mandrel 24 carrying wick drain material 26, but other elongate members may be driven by the system 20 in a similar manner.

The exemplary system 20 comprises a support assembly 28, a vibratory assembly 30, a gear drive assembly 32, and a shock absorbing assembly 34. The support assembly 28 comprises a support base 36, a mast 38, and mandrel support 40. The support base 36 is designed to engage a surface 42 of the ground 22 and provide a solid, stable surface for supporting the mast 38. The support base 36 can be a self-propelled platform such as a tracked vehicle or may, as shown, be placed directly onto the ground surface 42.

The mast 38 vertically extends from the support base 36, and the mandrel supports 40 horizontally extend from vertically spaced locations on the mast 38. The mandrel 24 is encircled by the mandrel supports 40 before and during insertion of the mandrel 24 into the ground 22. The support assembly 28 thus maintains the mandrel 24 in a desired orientation with respect to the ground; in the exemplary system 20, this desired orientation is vertical.

The vibratory assembly 30 is located in a channel 44extending from top to bottom through the support base 36. The shock absorbing assembly 34 mounts the vibratory assembly 30 within the channel 44 in a manner that: (a) maintains the vibratory assembly 30 in a desired location relative to the ground 22; and (b) absorbs vibratory forces generated by the vibratory assembly 30 and thus reduces the transmission of these forces to the support means. The vibratory assembly 30 is thus free to vibrate up and down within the channel 44, and only acceptably low levels of vibration are transmitted to the support base 36.

Figure 2:
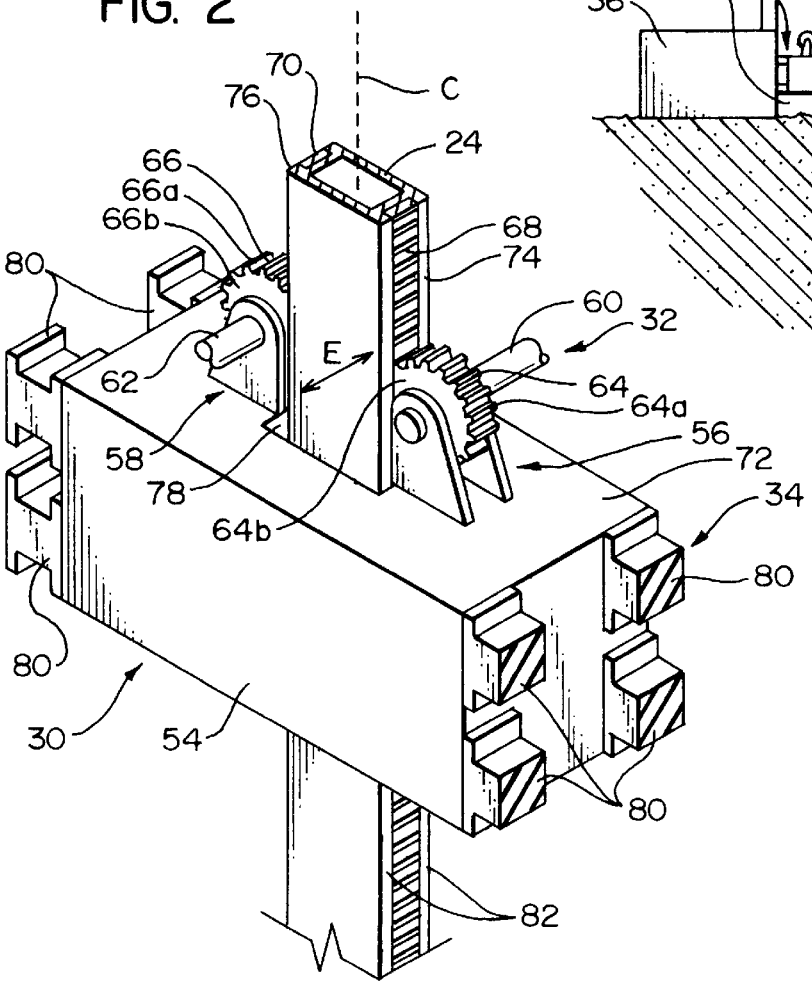
FIG. 2 is a perspective view of the vibratory assembly, gear drive assembly, and shock absorbing assembly of the system depicted in FIG. 1.
Figure 3:
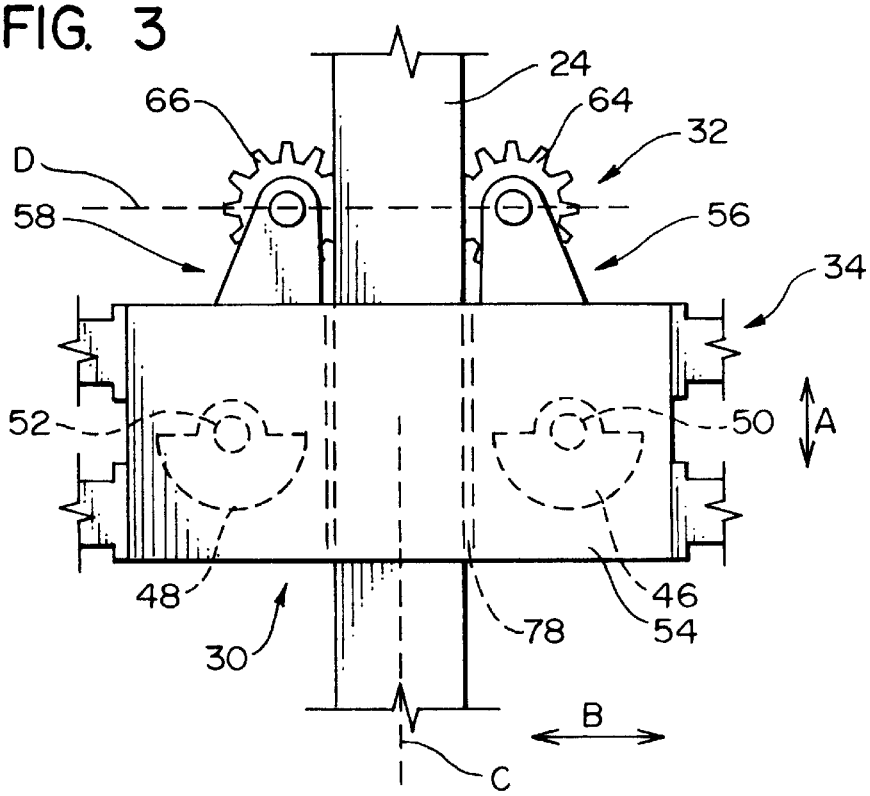
FIG. 3 is a side plan view of the assemblies depicted in FIG. 2.

Referring now to FIGS. 2 and 3, depicted in more detail therein are the mandrel 24, the vibratory assembly 30, the gear drive assembly 32, and the shock absorbing assembly 34.

Referring initially to the vibratory assembly 30, FIG. 3 shows a conventional vibratory assembly comprises first and second eccentric weight members 46 and 48 fixed onto vibratory shafts 50 and 52 mounted within a housing 54. The vibratory shafts 50 and 52 are horizontal and parallel to each other.

To cause the housing 54 to vibrate, the vibratory shafts 50 and 52 are rotated by motors (not shown) at the same speed in opposite directions, which causes the eccentric members 46 and 48 to rotate about the axes of these shafts 50 and 52. The eccentric members 46 and 48 are mounted on the vibratory shafts 50 and 52 such that: (a) the lateral forces on the housing 54 (in the direction of arrow B in FIG. 3) generated by the eccentric members 46 and 48 substantially cancel each other; while (b) the vertical forces on the housing 54 (in the direction of arrow A in FIG. 3) generated by the eccentric members 46 and 48 are added to each other and transmitted to the housing 54. The result is that this rotation of the eccentric members 46 and 48 causes the housing 54 to vibrate with great force along a vibratory axis in the vertical direction and very little in the lateral direction.

The gear drive assembly 32 is perhaps best shown in FIG. 2. The gear drive assembly 32 basically comprises first and second bracket assemblies 56 and 58, first and second drive shafts 60 and 62, and first and second drive gears 64 and 66, and first and second drive racks 68 and 70. The bracket assemblies 56 and 58 are securely attached to an upper surface 72 of the vibratory housing 54. The drive shafts 60 and 62 are mounted on the bracket assemblies 56 and 58, respectively, above the housing surface 72 such that the shafts 60 and 62 can be rotated about their axes. The drive gears 64 and 66 are mounted on the drive shafts 60 and 62 such that the gears 64 and 66 are securely held at a fixed distance above the housing surface 72.

The first and second drive racks 68 and 70 are formed on opposite surfaces 74 and 76 of the mandrel 24. The mandrel 24 extends through a vertical mandrel passageway 78 formed in the housing 54 such that the racks 68 and 70 engage teeth 64*a* and 66*a* of the drive gears 64 and 66.

Accordingly, rotation of the drive shafts 60 and 62 in the opposite direction by a motor (not shown) causes the drive gears 64 and 66 to rotate, which in turn causes the gear teeth 64*a* and 66*a* to engage the drive racks 68 and 70 to displace the mandrel 24 along its lengthwise axis C (FIG. 2). In this fashion, the mandrel 24 can be moved either up or down along its axis C relative to the vibratory housing 54.

At this point, it should be noted that the unshown motors employed to turn the vibratory shafts 50 and 52 and the drive shafts 60 and 62 are preferably direct fluid to torque hydraulic motors. The motors should be able to withstand severe vibration because they must be mounted on the vibratory housing 54, and direct fluid to torque motors are much less susceptible to vibration damage than hydraulic motors employing a planetary gear. Appropriate direct fluid to torque hydraulic motors are available from, for example, POCLAIN under the model name CAM TRACK. The source of the pressurized fluid employed to drive these motors is preferably mounted on the support base 36 and connected to the hydraulic motors via flexible hoses. This arrangement of hydraulic motors and fluid source minimizes: (a) the amount of equipment that is directly subjected to the vibratory forces generated by the vibratory assembly 30; and (b) the damage to the equipment that is subjected to these vibratory forces.

Referring now to FIGS. 2 and 3, these Figures show that the shock absorbing assembly 34 comprises eight rectangular solid shock absorbing members 80 (only seven shown in FIG. 2) that are flanged such that they can be bolted to the vibratory housing 54 and the support base 36. These members 80 are made of strong, resilient, rubber-like material. When the vibratory housing 54 vibrates up and down, these shock absorbing members 80 allow the housing to move up and down a short distance relative to the support base 36; in doing so, the members 80 yieldingly resist the transmission of vibratory forces from the vibratory housing 54 to the support base 36. Accordingly, the shock absorbing assembly 34 effectively isolates the support base from the vibratory forces generated by the vibratory assembly 54.

In operation, the mandrel 24 will initially be arranged with a lower end 24*a* thereof adjacent to the surface 42 of the ground 22 and with the wick drain material 26 loaded therein. The drive shafts 60 and 62 will then be rotated to cause the mandrel 24 to enter the ground 22. The downward force applied by the gear drive assembly 32 may in many cases be sufficient to drive the mandrel 24 to the desired depth.

However, in some cases, the soil conditions of the ground 22 may be such that the force applied by the gear drive assembly 32 is insufficient and the mandrel 24 can not be inserted into or withdrawn from the ground 22. In these cases, the vibratory shafts 50 and 52 may be rotated to cause the vibratory housing 54 to vibrate up and down. These vibratory forces will be transmitted to the mandrel 24 at the points where the teeth 64*a* and 66*a* of the drive gears 64 and 66 engage the drive racks 68 and 70. The mandrel 24 will thus be vibrated up and down along its axis C. Such vibration is extremely effective at overcoming resistance to the insertion and withdrawal of the mandrel 24.

Further, the vibratory forces generated by the vibratory assembly 30 may be applied at the same time as the drive forces generated by the gear drive assembly 32; the gear drive assembly 32 is mounted on the vibratory housing 54 and will move up and down at the same rate as the vibratory housing 54. The combination of a driving force and a vibratory force can greatly increase the speed at which the mandrel 24 is inserted into and withdrawn from the ground 22.

The elongate member insertion/withdrawal system 20 thus exhibits all of the benefits of a bottom drive system as described above but in addition allows the use of vibratory forces when soil conditions require such forces and simply to speed up the process of inserting or removing wick drain mandrels.

Several features of the insertion/withdrawal system 20, while not essential to the operation of the present invention, are believed to optimize the implementation of the present invention and will now be discussed in further detail.

For example, FIGS. 2 and 3 both show that the vibratory assembly 30 is substantially symmetrically arranged about the axis C of the mandrel 24. More particularly, as shown in FIG. 3 the eccentric members 46 and 48 and shafts 50 and 52 connected thereto are arranged the same distance from the mandrel axis C, with the shafts 50 and 52 orthogonal to this axis C. With this arrangement, the vibratory forces are applied along the mandrel axis C. Without such symmetry, the vibratory forces would cause a torsional load to be exerted on the mandrel 24. Such a torsional load would increase the stress on the mandrel 24 and/or the gear drive assembly 32 that engages the mandrel 24 and thus the likelihood of damage thereto.

Another optional feature of the present invention is the location of the drive gears 64 and 66 relative to the mandrel 24. The lateral forces applied on the mandrel 24 by these gears 64 and 66 are in opposite directions along a line D shown in FIG. 3. With this arrangement, it is not necessary to pinch the mandrel 24 at two points in order to displace it along its axis; instead, the gears 64 and 66 need only apply sufficient lateral loads to maintain the mandrel 24 at the center of the passageway 78. This eliminates the need to place a constant load on the mandrel 24 and thus reduces stresses thereon. The placement of the gears 64 and 66 also mean that the vertical vibratory forces transmitted to the mandrel 24 are applied in a symmetrical fashion that alleviates twisting of the mandrel 24. The lateral forces applied on the mandrel 24 by these gears 64 and 66 are in opposite directions along a line D shown in FIG. 3. With this arrangement, it is not necessary to pinch the mandrel 24 at two points in order to displace it along its axis; instead, the gears 64 and 66 need only apply sufficient lateral loads to maintain the mandrel 24 at the center of the passageway 78. This eliminates the need to place a constant load on the mandrel 24 and thus undue stresses thereon. The placement of the gears 64 and 66 also means that the vertical vibratory forces transmitted to the mandrel 24 are applied in a symmetrical fashion that alleviates twisting of the mandrel 24.

Another noteworthy but non-essential feature of the present invention is that the drive racks 68 and 70 are recessed into the mandrel surfaces 74 and 76.

This creates ridges 82 extending along the length of the racks 68 and 70 that engage the sides 64*b* and 66*b* of the drive gears 64 and 66 to prevent the mandrel 24 from moving in either direction along an arrow E in FIG. 2; this direction shown by arrow E is orthogonal to the mandrel axis C and to the line D shown in FIG. 3.

2. Second Embodiment

Figure 4:
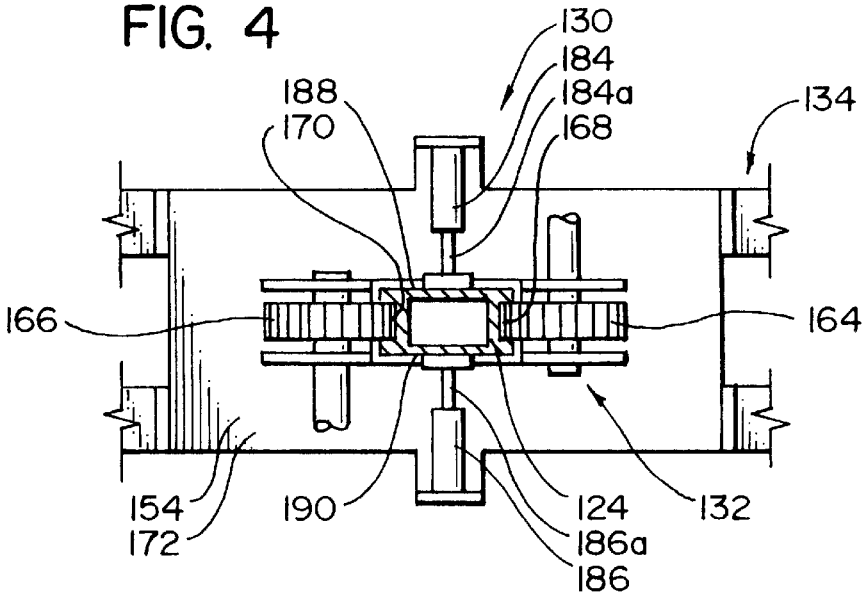
FIG. 4 is a top plan view of a portion of a second exemplary elongate member insertion/removal system that is constructed in accordance with the principles of the present invention.

A second exemplary elongate member insertion/withdrawal system will now be described with reference to FIG. 4. In FIG. 4, components that are the same as those described above with reference to FIGS. 1–3 will be given the same reference character plus one hundred. Such like components will not be described again in detail below.

FIG. 4 shows that securely secured to the upper surface 172 of the vibratory housing 154 are first and second hydraulic piston assemblies 184 and 186. These assemblies 184 and 186 are arranged on opposite sides of the mandrel 124. Pistons 184*a* and 186*a* are extendable from the assemblies 184 and 186, respectively, to engage opposite surfaces 188 and 190 of the mandrel 124.

Thus, by appropriate application of hydraulic fluid to the piston assemblies 184 and 186, the pistons 184*a* and 186*a* of these assemblies can engage the mandrel 124 to fix the position of the mandrel 124 relative to the vibratory housing 154. This allows the vibratory forces generated by the vibratory assembly 130 to be transmitted to the mandrel 124 primarily through the piston assemblies 184 and 186 and only to a lesser extent through the gear drive assembly 132. The piston assemblies 184 and 186 can thus alleviate wear on the drive gears 164 and 166 and the drive racks 168 and 170 in situations where the mandrel 124 is only being vibrated and not driven along its axis.

Figure 5:
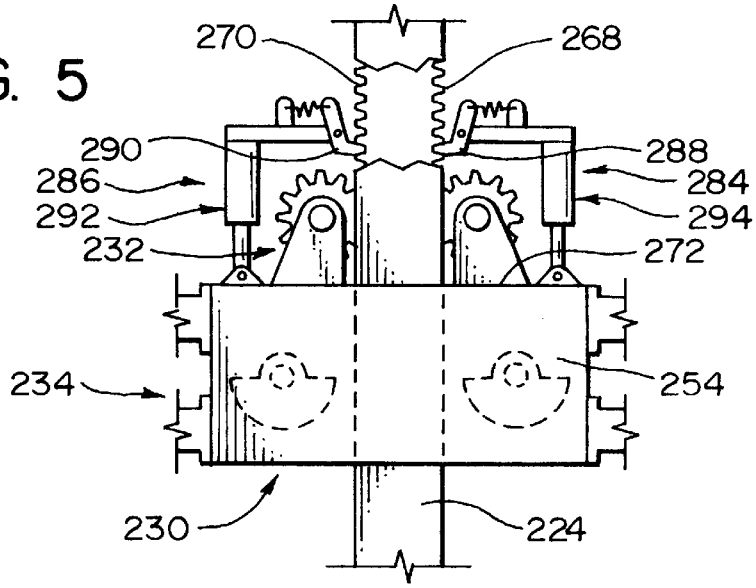
FIG. 5 is a side plan view of a portion of a third exemplary elongate member insertion/removal system that is constructed in accordance with the principles of the present invention.

A third exemplary elongate member insertion/withdrawal system will now be described with reference to FIG. 5. In FIG. 5, components that are the same as those described above with reference to FIGS. 1–3 will be given the same reference character plus two hundred. Such like components will not be described again in detail below.

FIG. 5 shows that securely mounted onto the upper surface 272 of the vibratory housing 254 of this third exemplary system are first and second hydraulic drive assemblies 284 and 286. These hydraulic drive assemblies 284 and 286 are arranged to apply vertical forces on the mandrel 224.

In particular, during normal operation engaging members 288 and 290 of these assemblies 284 and 286 are disengaged from the racks 268 and 270 and the mandrel 224 is driven by the gear drive assembly 232. However, when the forces generated by the gear drive assembly 232 are not sufficient to insert or withdraw the mandrel 224, the engaging members 288 and 290 engage the mandrel 224 through the racks 268 and 270.

Drive piston assemblies 292 and 294 of the hydraulic drive assemblies 284 and 286 are then operated to act on the mandrel 224 through the members 288 and 290 and force the mandrel 224 in either direction along its axis. The forces of the hydraulic drive assemblies 284 and 286 may be sufficient to insert or withdraw the mandrel 224 in cases where the forces generated by the gear drive assembly 232 are not. Further, the hydraulic drive assemblies 284 and 286 will be particularly effective when used in conjunction with vibratory forces generated by the vibratory assembly 230.

3. Third Embodiment

Figure 6:
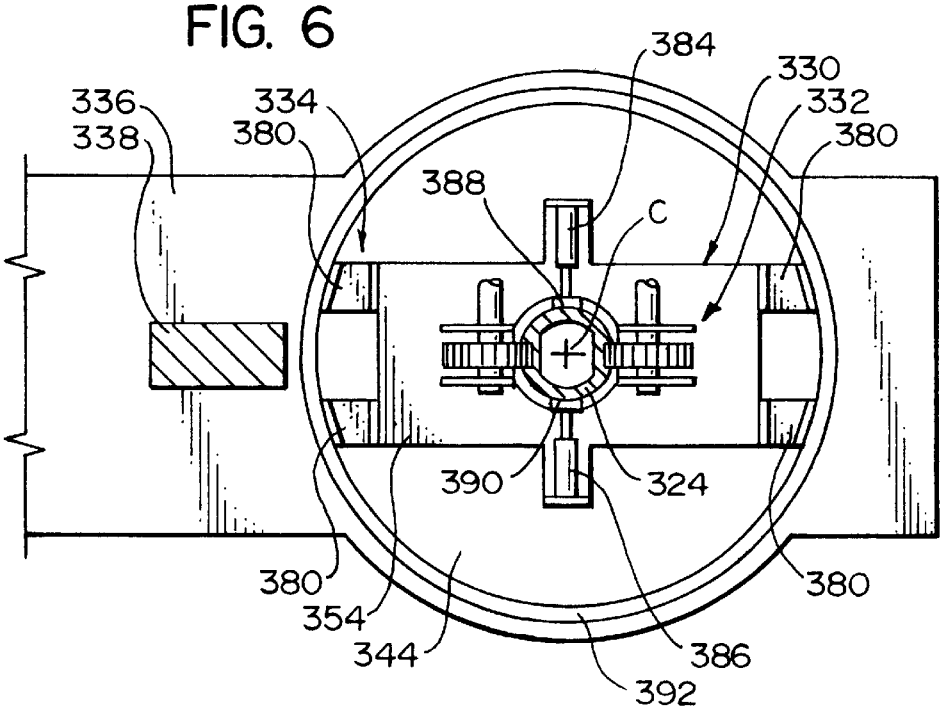
FIG. 6 is a top plan view of a portion of a third exemplary elongate member insertion/removal system that is constructed in accordance with the principles of the present invention.

A third exemplary elongate member insertion/withdrawal system will now be described with reference to FIG. 6. In FIG. 6, components that are essentially the same as those described above with reference to FIGS. 1–4 and will be given the same reference character plus three hundred. Such like components will be described below only to the extent that they differ from the corresponding components described above.

As shown in FIG. 6, in this third exemplary system the channel 344 in the support base 336 is cylindrical. Further, the shock absorbing means 380 of the shock absorbing assembly 334 are connected between the vibratory housing 354 and an intermediate ring 392 mounted onto the support base 336 within the channel 344. The intermediate ring 392 is rotatable about the mandrel axis C relative to the support base 336. Further, the mandrel 334 itself is rounded.

In use, the intermediate ring 392, and thus the vibratory assembly 330, gear drive assembly 332, and mandrel 324, may be rotated about the mandrel axis C. In certain situations rotation of the mandrel 324 may be needed to overcome soil conditions and drive the mandrel 324 into or remove the mandrel 324 from the ground 22. The rounded configuration of the mandrel 324 facilitates the rotation of the mandrel 324 about its axis.

4. Fourth Embodiment

Referring now to FIGS. 7–10, depicted at 420 therein is yet another wick drain inserting system constructed in accordance with, and embodying, the principles of the present invention.

The exemplary system 420 comprises an insertion assembly 422 that is pivotably connected to an arm 424 by a pin 426. The arm 424 is connected to an excavator, crane, or spotter (not shown) such that the insertion assembly 422 may be moved from place to place. An actuator assembly 428 is connected between the insertion assembly 422 and the arm 424. The effective length of the actuator assembly 428 may be increased or decreased; operating the actuator assembly 428 thus rotates the insertion assembly 422 about the longitudinal axis of the pin 426, thereby allowing an angle between the insertion assembly 422 and the arm 424 to be changed. Systems other than the arm 424, such as those described in the previous and subsequent embodiments, may be used to support the insertion assembly 422.

During use, the actuator assembly 428 allows the insertion assembly 422 to be arranged in a proper orientation with respect to the ground. During transportation and storage, the effective length of the actuator member 428 may be decreased so that the insertion assembly 422 is folded back substantially parallel to the arm 424.

The exemplary insertion assembly 422 comprises a mast or boom assembly 430, a housing assembly 432, a mandrel assembly 434, a linear drive assembly 436, a vibration assembly 438, a suppression assembly 440 (FIG. 9), and a feed subsystem 442.

Figure 7:
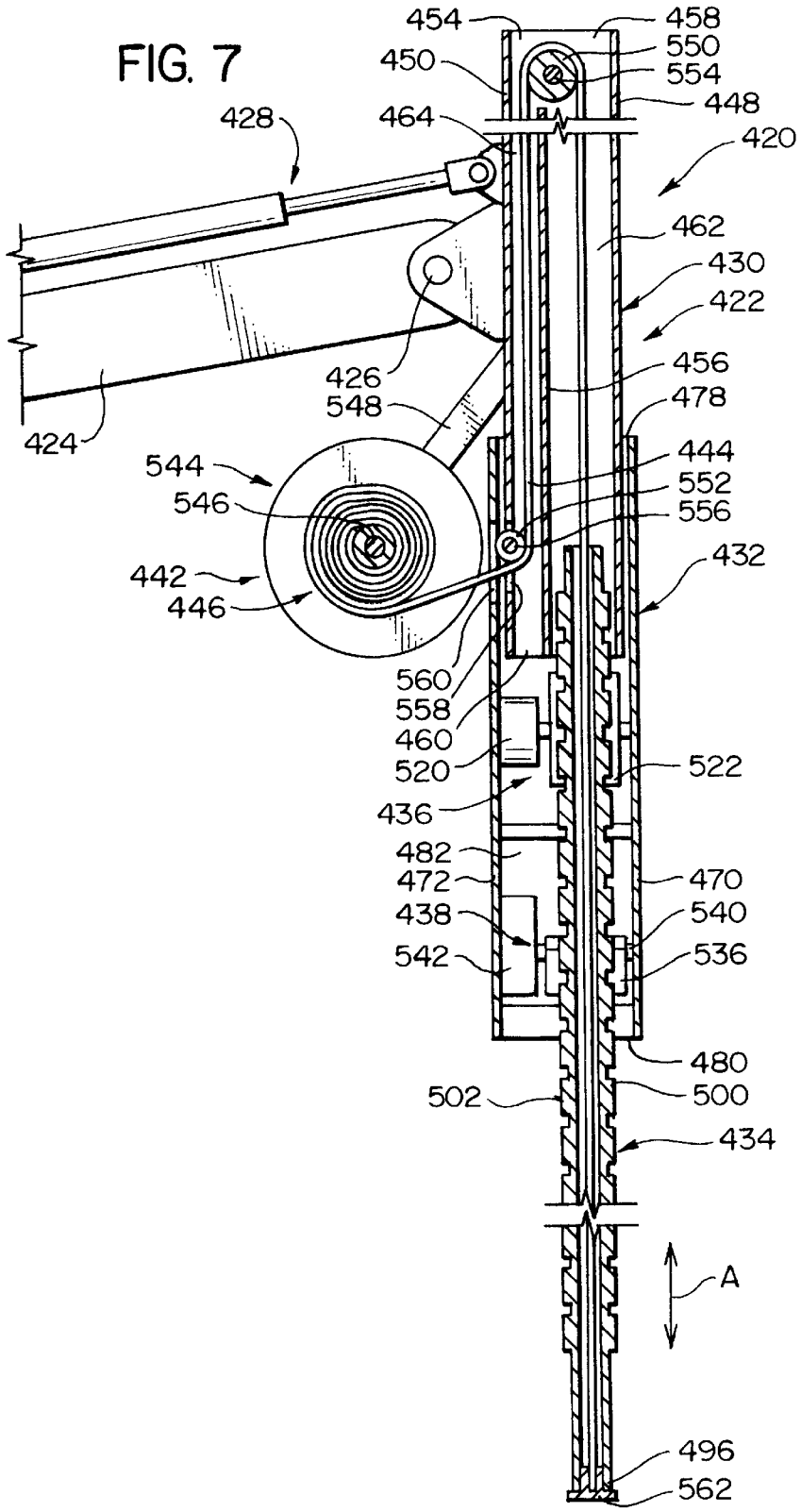
FIG. 7 is a vertical section view of an insertion assembly constructed in accordance with, and embodying, the principles of the present invention.

The linear drive assembly 436 is arranged to displace the mandrel assembly 434 along its axis relative to the housing assembly 432 (in the direction shown by arrow A in FIG. 7). The linear drive assembly 436 also transfers loads on the housing assembly 432 to the mandrel assembly relative.

The vibration assembly 438 may be operated to cause the housing assembly 436 to vibrate in the direction shown by arrow A. Vibratory forces on the housing assembly 436 are transferred to the mandrel assembly 434 by the mandrel drive assembly 436.

The suppression assembly 440 connects the mast assembly 430 to the housing assembly 432 such that the housing assembly 432 may move within a limited range relative to the mast assembly 430. The purpose of the suppression assembly 440 is to inhibit the transfer of the vibratory loads from the housing assembly 440 to the mast assembly 430.

The feed subsystem 442 is configured to feed wick drain material 444 from a roll 446 into the mandrel assembly 434.

The insertion system 420 operates basically as follows. The arm 424 is moved and actuator assembly 428 operated until the insertion assembly 422 is vertically arranged above a desired location at which the wick drain material 444 is to be inserted into the earth. The linear drive assembly 436 is operated to crowd the mandrel assembly 434 into the earth at the desired location. In many situations, excessive resistance will not be encountered, and the linear drive assembly 436 alone will drive the mandrel assembly 434 to its desired depth.

Should the system 420 encounter excessive resistance using the linear drive assembly 436 alone, the vibration assembly 438 may be operated. In most cases, excessive resistance can be overcome by the combination of crowding using the linear drive system 436 and the vibratory loads generated by the vibration assembly 438. Accordingly, both the linear drive assembly 436 and the vibration assembly 438 will be used together whenever excessive resistance is encountered.

Once the excessive resistance is overcome, the vibration assembly 438 will be turned off; in general, vibration is hard on equipment and thus should be used only when necessary.

After the mandrel assembly 434 has been driven to its desired depth, the linear drive assembly 436 will be reversed to withdraw the mandrel assembly 434 from the ground.

With the foregoing general explanation in mind, the construction and operation of the system 420 will now be described in further detail.

Figure 9:
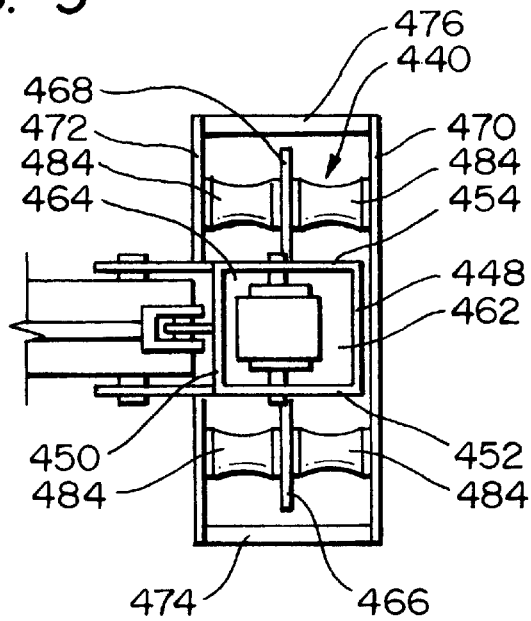
FIG. 9 is a top plan view of the insertion assembly of FIG. 7 with background details omitted for clarity.

As perhaps best shown in FIGS. 7 and 9, the mast assembly 430 comprises a front wall 448, a back wall 450, a first side wall 452, a second side wall 454, and an interior wall 456 (FIG. 7). The walls 448–54 are joined together to form an elongate box such that the mast assembly has an open upper end 458 and an open lower end 460. The interior wall 456 divides the interior of the mast assembly 430 into a forward compartment 462 and a rear compartment 464. The mast assembly 430 further comprises first and second side flanges 466 and 468 that rigidly extend from the first and second side walls 452 and 454 adjacent to the mast lower end 460.

Figure 8:
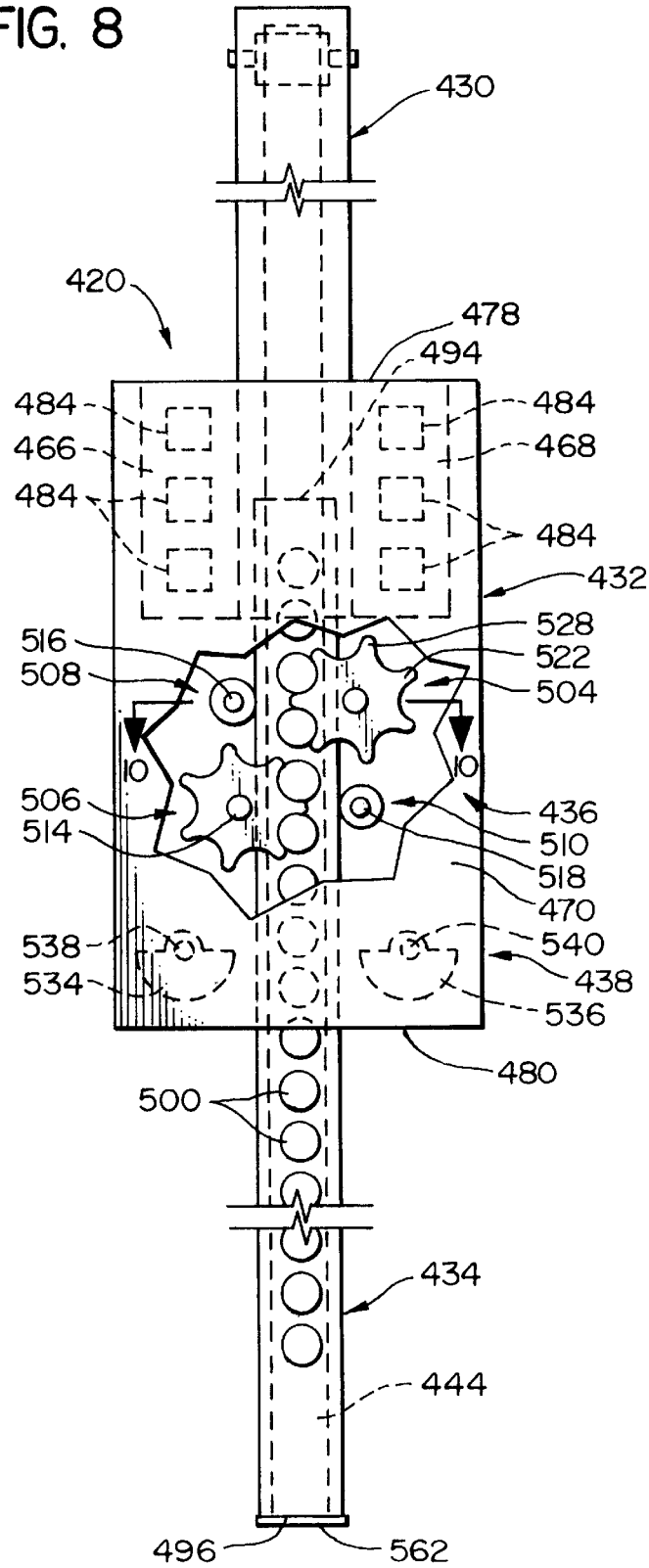
FIG. 8 is a front plan view of the insertion assembly of FIG. 7.

FIGS. 7, 8, and 9 illustrate that the housing assembly 432 comprises a front wall 470, back wall 472, first side wall 474, and second side wall 476. These walls 470–76 are joined together to form a box such that the housing assembly 432 has an open upper end 478 and open lower end 480 and defines a housing chamber 482.

The mast assembly 430 extends through the housing upper end 478 and partially into the housing chamber 482. In particular, as perhaps best shown in FIGS. 8 and 9, the mast flanges 466 and 468 and portions of the mast walls 448–54 adjacent to these flanges 466 and 468 normally reside completely within the housing chamber 482.

The exemplary suppression assembly 440 comprises twelve elastomeric members 484. As shown in FIG. 8, six of these member 484 are connected between front surfaces of the mast flanges 466 and 468 and the rear surface of the housing front wall 470. Six of these members are also connected between rear surfaces of the mast flanges 466 and 468 and the front surface of the housing rear wall 472.

The elastomeric members 484 allow, but resiliently oppose, a small degree of relative movement between the mast assembly 430 and the housing assembly 432. These members 484 thus transfer loads between the mast assembly 430 and the housing assembly 432 but absorb shocks that would otherwise be transmitted between these assemblies. More specifically, these elastomeric members 484 prevent transmission of most vibratory loads and shocks from excessive ground resistance from the housing assembly 432 to the mast assembly 430. This protects the mast assembly 432 and arm 424 from these shocks.

Figure 10:
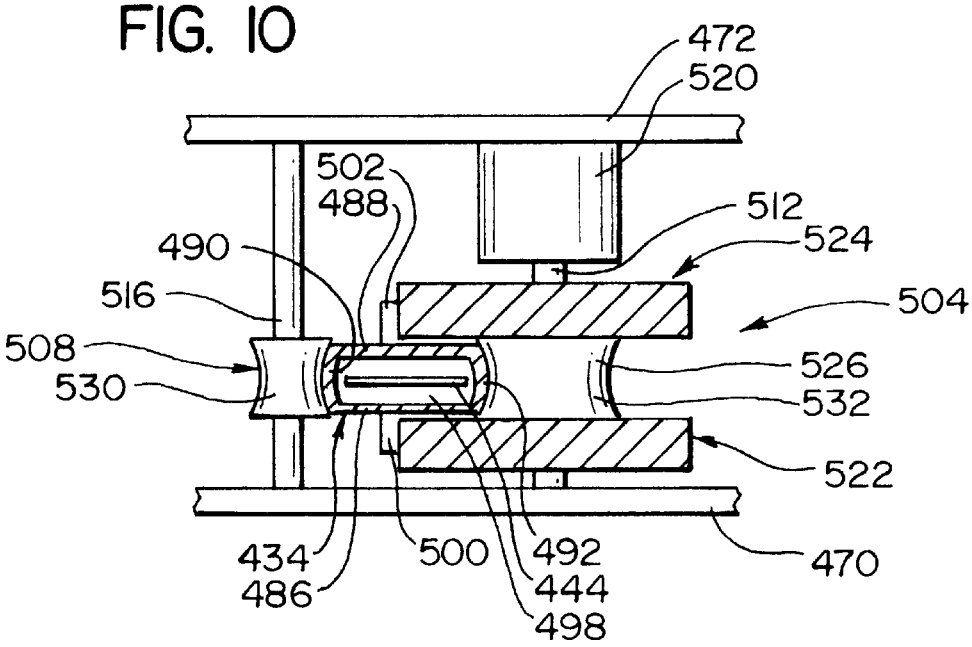
FIG. 10 is a top section view taken along lines 10—10 in FIG. 8, again with background details omitted for clarity.

Referring now to FIG. 10, it can be seen that the mandrel assembly 434 comprises a front wall 486, back wall 488, first side wall 490, and second side wall 492. These walls 486–92 are joined together in an elongate box such that the mandrel assembly has an open upper end 494 and an open lower end 496 and defines a mandrel chamber 498. The front and back walls 486 and 488 are flat, while the side walls 490 and 492 are outwardly curved.

Extending from the front wall 486 is a first row of pins 500, and extend from the back wall 488 is a second row of pins 502. These pins 500 and 502 extend approximately one-half an inch from and are evenly spaced along the length of the mandrel front and back walls 486 and 488. In the preferred embodiment, these pins are short hollow tubes secured by welding to the mandrel walls 486 and 488.

The mandrel assembly 434 is sized and dimensioned such that it may be received within the mast forward compartment 462.

The linear drive system 436 is shown in FIGS. 7, 8, and 10. This system 436 comprises first and second gear assemblies 504 and 506 and first and second roller assemblies 508 and 510. The gear assemblies 504 and 506 are mounted on shafts 512 and 514, and the roller assemblies 508 and 510 are mounted on shafts 516 and 518. The gear assemblies 504 and 506 are or may be almost identical to each other; similarly, the roller assemblies 508 and 510 are or may be almost identical to each other. Accordingly, only the gear assembly 504 and roller assembly 508 will be described in detail herein.

As shown in FIG. 10, the shafts 512 and 516 are connected to inner surfaces of the housing front wall 470 and housing rear wall 472. The gear shaft 512 is axially rotated by a hydraulic motor 520. The motor 520 is conventional and will not be discussed herein in detail.

The gear assembly 508 comprises first and second gear members 522 and 524 and a center portion 526. The gear members 522 and 524 comprise a series of teeth 528 radially extending from the shaft 512. The shafts 512 and 516 are configured such that the center portion 526 opposes the roller assembly 508.

The gear center portion 526 engages the mandrel second side wall 492 and the roller assembly 508 engages the mandrel first side wall 490. The center portion 526 and roller assembly 508 are arranged to prevent significant lateral motion of the mandrel assembly 434 relative to the housing assembly 432.

As shown in FIG. 10, the mandrel assembly 434 extends between the gear assembly 504 and the roller assembly 508. In particular, the gear assembly 504 straddles the mandrel assembly 434 such that the gear members 522 and 524 extend over a portion of the mandrel front and back walls 486 and 488, respectively. The teeth 528 extend between the pins 500 and 502 such that movement of the teeth 528 is transferred to the mandrel assembly 434.

Accordingly, when the motor 520 axially rotates the shaft 512, the gear members 522 and 524 rotate about the axis of the shaft 512; the gear teeth 528 engage the mandrel pins 500 and 502 such that, as the gear members 522 and 524 rotate, the mandrel assembly 434 is driven along its longitudinal axis. In particular, with reference to FIG. 8, clockwise rotation of the gear assembly 504 will result in upward movement of the mandrel assembly 434, while counterclockwise rotation of the gear assembly 504 will result in downward movement of the mandrel assembly 434.

In addition, the teeth 528 engage the pins 500 and 502 and the gear center portion 526 and roller assembly 508 engage the mandrel side walls 490 and 492 such that loads on the housing assembly 432 are transferred to the mandrel assembly 434, and vice versa.

In particular, the teeth 528 are contoured such that each tooth extending between two pins is in contact with the pin above and pin below. This transfers vertical loads between the housing assembly 432 and mandrel assembly 434 and reduces play in the system when the direction in which the mandrel assembly 434 is driven needs to be changed. The roller assembly 508 and gear center portion 526 have concave outer surfaces 530 and 532 that match the convex side walls 490 and 492 of the mandrel assembly 434. And the gear members 522 and 524 are closely arranged adjacent to the mandrel front and back walls 486 and 488.

This configuration ensures that front-back, side, and vertical loads are all transferred between the housing and mandrel assemblies 432 and 434 without substantial movement between these assemblies.

As shown in FIG. 8, the vibration assembly 438 comprises a pair of eccentric weights 534 and 536 mounted on shafts 538 and 540 extending between the front and back housing walls 470 and 472. A conventional hydraulic motor 542 rotates the weights 534 and 536 in synchrony in opposite directions to develop a vertical vibratory force that is applied to the housing assembly 432 through the shafts 538 and 540.

As described above, vertical loads on the housing assembly 432 are applied to the mandrel assembly 434 by the gear assemblies 504 and 506 and roller assemblies 508 and 510. Thus, the vibratory forces generated by the vibration assembly 438 are transmitted to the mandrel assembly 434.

Referring again to FIG. 7, it can be seen that the feed subsystem 442 comprises a reel assembly 544 mounted on a shaft 546 extending between to reel struts 548 (only one shown in FIG. 7). The roll 446 of wick drain material 448 is placed onto the reel assembly 544.

The feed subsystem 442 further comprises upper and lower feed rollers 550 and 552 mounted on the mast assembly 430 adjacent to the mast upper and lower ends 458 and 460, respectively. As shown in FIG. 9, the upper feed roller is mounted on a shaft 554 extending between the mast side walls 452 and 454 above an upper edge surface of the internal wall 456. The lower roller 552 is mounted on a shaft 556 extending between the side walls 452 and 454 within a mast feed hole 558 formed in the mast back wall 450. A housing feed hole 560 is formed in the housing back wall 472 adjacent to the mast feed hole 558.

The wick drain material 444 is fed from the roll 446, through the housing feed hole 560 and mast feed hole 558, under the lower feed roller 552, through the rear mast compartment 464, over the upper feed roller 550, through the forward mast compartment 462, through the mandrel chamber 498, and to the mandrel lower end 496. At the mandrel lower end 496, the wick material 444 is attached to a wick drain shoe 562.

With the foregoing more detailed understanding of the construction of the system 420, the use of this system 420 will now be described in further detail.

A first operator will be sitting in an excavator or crane from which the arm 424 extends. A second operator will be on foot.

The first operator can look down the arm 424 towards the housing back wall 472. The excavator or crane is basically conventional, so the first operator may control the position of the insertion assembly 422 by operating the excavator or crane and the hydraulic assembly 428. The first operator thus arranges the insertion assembly 422 such that the mandrel lower end is located above the desired location where the wick drain material is to be inserted and the mast is at the appropriate angle with respect to vertical.

One of the operators operates the linear drive assembly 436 to rotate the gear assemblies 504 and 506, thereby crowding the mandrel assembly 434 into the earth. Because the wick drain material 444 is attached to the shoe 562, as the mandrel assembly 434 is crowded into the earth, the wick drain material 44 is taken off of the roll 446 by the feed subsystem 442 and placed into the earth with the mandrel assembly 434.

Should the mandrel assembly 434 encounter excessive ground resistance, the operators will notice the housing assembly 432 begin to move up relative to the boom assembly 430 by stretching the resilient members 484. At this point, the operator can operate the vibration assembly 438; this will cause the housing assembly 432 to move up and down at a rate related to the rotational speed of the weights 434. This up and down movement will be transferred to the mandrel assembly 434, which will help to overcome the excessive resistance and allow the mandrel assembly 434 to be crowded through the obstruction in the soil. The vibration assembly 438 is then turned off until another obstruction is encountered.

After the mandrel assembly 434 has been driven to its desired depth, the direction of the linear drive system 436 is reversed to withdraw the mandrel assembly 434 from the earth. Because the shoe 562 is not attached to mandrel assembly 434, the shoe 562 remains at the desired depth; and because the wick drain material 444 is attached to the shoe 562, the wick drain material remains in the hole formed by the mandrel assembly 434.

When the mandrel assembly 434 is completely withdrawn from the ground, the second operator will cut the wick drain material 444 above the ground and attach a new shoe 562 thereto. The system 420 is then moved to place the insertion assembly 422 at a new desired location, and the process described above is repeated.

The present invention provides a number of advantages over prior art methods.

By keeping the drive and vibration assemblies close to the ground, the mast need not be heavy. This allows potentially taller masts, as the mast only needs to bear the weight of the wick drain material; the linear drive assembly will support the mandrel. The mast assembly may even be constructed with a metal lower portion that is connected to the excavator arm and housing assembly and a plastic upper portion for supporting the wick drain material. With a light mast, the entire system can be made small and transportable, even to the extent that it can be mounted on a conventional excavator or crane with a large vertical mast. And this lightweight mast can be rotated downward for easy transportation and storage.

By driving the mandrel through the center of the vibration assembly, the vibrational loads are symmetrically applied to the mandrel. Such symmetrical loads reduce wear and tear on the mandrel and decrease the chance that the mandrel will fail during vibration.

The mandrel itself has a very small footprint. This is important as it reduces the amount that the mandrel compacts the soil as it is being driven into the earth. Compaction is a problem because it can interfere with flow of water to the wick drain for wicking to the surface.

The arrangement of two gear assemblies each having two gear members helps to balance the loads while the mandrel is being crowded into the ground.

This arrangement also helps ensure that the vibratory loads applied to the mandrel are balanced. The placement of one gear assembly above the other allows the gear teeth to extend over half way between the mandrel pins, thus ensuring a secure transfer of downward motion to the mandrel. The vertically staggered gear teeth also force dirt out from between adjacent mandrel pins, removing dirt that might interfere with the insertion or removal of the mandrel.

This system of the present invention can also be easily manufactured from conventionally available parts.

5. Fifth Embodiment

Figure 11:
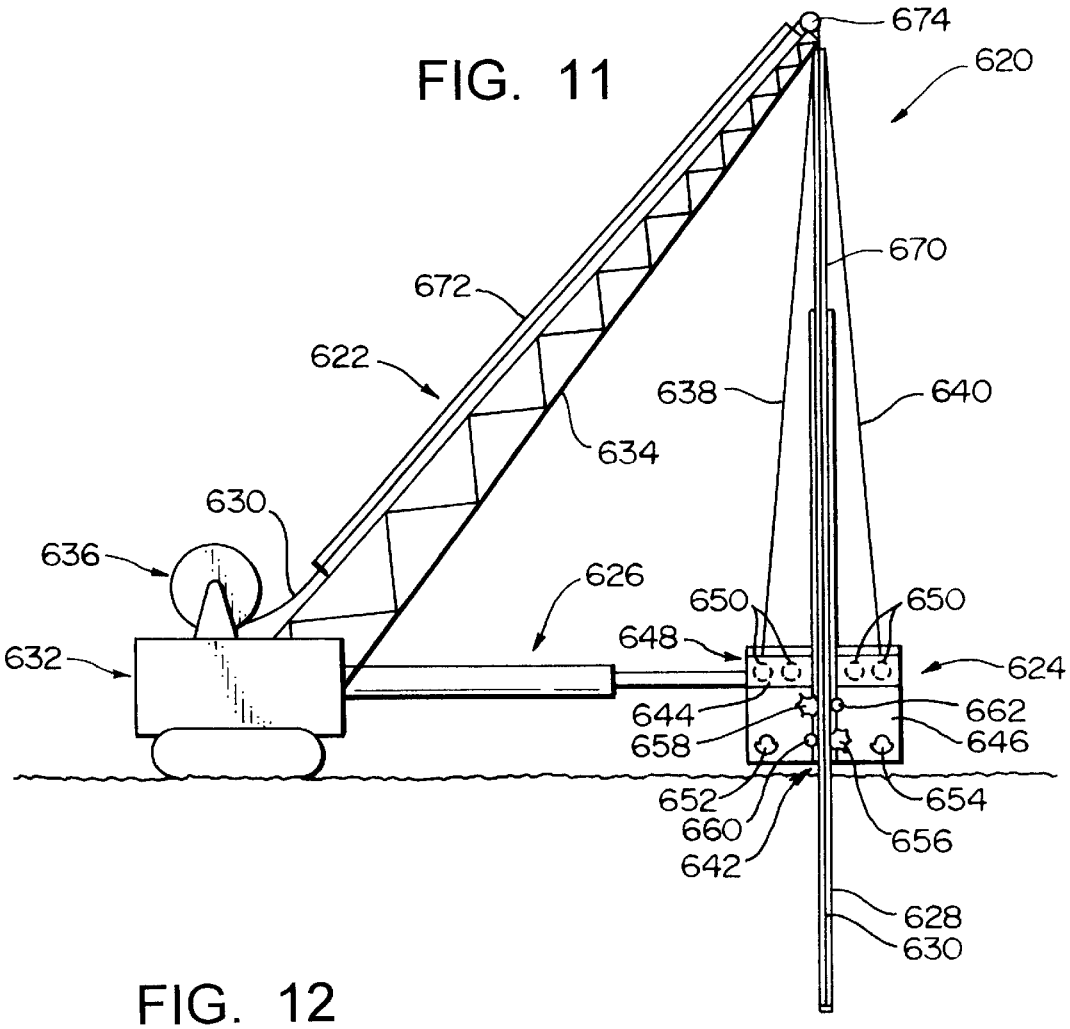
FIG. 11 is a somewhat schematic side elevation view of yet another exemplary elongate member insertion/removal system that is constructed in accordance with the principles of the present invention.

Referring now to FIG. 11 depicted therein at 620 is a wick driving system constructed in accordance with, and embodying, the principles of the present invention. This system 620 comprises a crane 622, an insertion assembly 624, a spotter 626, a mandrel 628, and wick drain material 630.

The crane 622 is generally conventional in that it has a cab portion 632 and a boom portion 634. Mounted on the conventional crane 622 is a roll 636 of the wick drain material 630.

Attached to the upper end of the boom 634 are first and second cables 638 and 640. These cables suspend the insertion assembly 624 above a location 642 at which the wick drain material 630 is to be inserted into the earth.

The insertion assembly 624 is schematically depicted in FIG. 11. Additionally, one side of the insertion assembly 624 is not shown so that the operation of the insertion assembly 624 may more easily be described.

In particular, the insertion assembly 624 comprises a fixed plate 644 to which the cable 638 and 640 are connected. This fixed plate 644 is connected to a housing 646 by a suppression system 648 comprising a plurality of elastomer blocks 650. The blocks 650 allow the housing 646 to move relative to the plate 644.

Mounted within the housing 646 are vibratory members 652 and 654 that are eccentric and rotate at the same speed in opposite directions such that lateral forces are cancelled and an up and down vibratory force is created. These vibratory devices 652 and 654 are well known in the art and will not be described in detail herein.

Further mounted to the housing 646 are drive gears 656 and 658. Opposing these drive gears 656 and 658 are rollers 660 and 662.

The mandrel 628 extends through the housing 646 between the vibratory devices 652 and 654, drive gear 656 and roller 660, and drive gear 658 and roller 662. The insertion assembly 624 is symmetrically arranged about the mandrel 628 such that the vibratory loads created by the vibratory devices 652 and 654 are applied symmetrically through the drive gears 656 and 658 and rollers 660 and 662 directly along a longitudinal axis of the mandrel 628.

The drive gears 656 and 658 are rotated to crowd the mandrel 628 into the earth or, in the opposite direction, to remove the mandrel 628 from the earth. When resistance is encountered, the vibratory devices 652 and 654 may be operated to impart vibratory loads to the mandrel 628; these loads assist the insertion/withdrawal of the mandrel 628. The vibration suppression system 648 inhibits transmission of vibratory loads from the housing 646 to the fixed plate 644.

As described above, the upper end of the crane boom 634 is connected by the cable 638 and 640 to the fixed plate 644. These cables 638 and 640, and thus the boom 634, are thus also at least partly isolated from the vibratory loads generated by the insertion assembly 624.

Optionally, as shown in FIG. 11, a spotter assembly 626 may be connected between the fixed plate 644 and the crane base 632. The spotter assembly 626 is conventional and allows the insertion assembly 624 to be moved relative to the crane base 632. Again, the spotter assembly 626 is connected to the fixed plate 644 and thus is as least partly isolated from the vibratory loads generated by the insertion assembly 624.

The insertion assembly 624 may thus be positioned above the desired location 642 by the crane 622 alone. The spotter assembly 626 will help with precise placement of the insertion assembly 624 and will help to prevent raising of the assertion assembly 624 when the mandrel 628 encounters difficulties while being inserted.

FIG. 11 also shows that the system 620 may optionally comprise a wind sleeve 670 and a boom sleeve 672. The wind sleeve 670 is attached at its upper end to the uppermost portion of the boom 634. The lower end of the wind sleeve 670 extends into the mandrel 628. The wind sleeve 670 thus prevents the wind from acting on the portion of the wick drain material 630 that extends between the top the boom 634 and the top of the mandrel 628.

The boom sleeve 672 is attached to the boom 634 and provides a channel through which the wick drain material 630 passes from the roll 636 up to the top of the boom 634. A roller 674 may optionally be provided at the top of the boom 634 to help feed the wick drain material 630 from the boom tube 672 into the wind tube 670.

Figure 12:
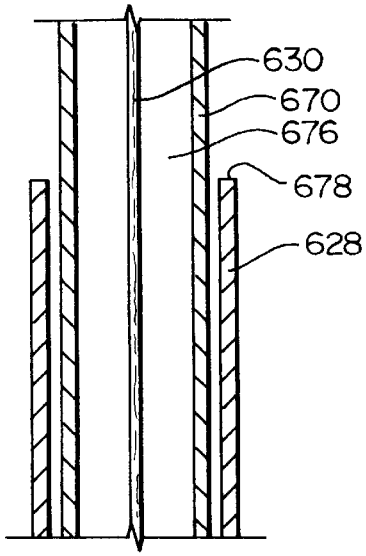
FIG. 12 is a section view of the upper end of a mandrel being driven by the system of FIG. 11 depicting an interaction between the mandrel and a wind sleeve that protects the wick material above the mandrel.

FIG. 12 shows that the wind tube 670 is hollow and defines a wind tube chamber 676 through which the wick drain material 630 passes. FIG. 12 also shows an upper end 678 of the mandrel 628.

Figure 13:
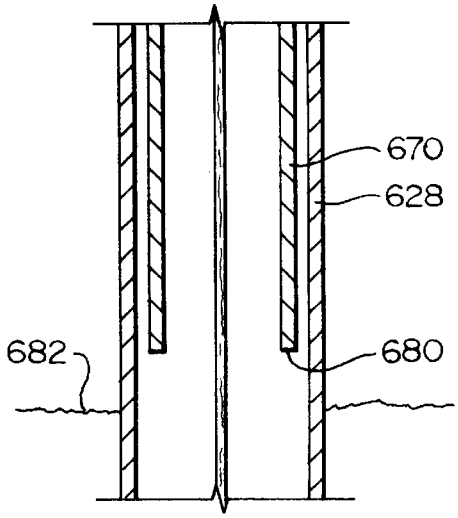
FIG. 13 is a section view of the lower end of the wind sleeve of the system of FIG. 11 depicting the interaction between the mandrel and the wind sleeve.

Referring to FIG. 13, depicted therein is a lower end 680 of the wind tube 670. This lower end 680 is at or near a surface 682; preferably, but not necessarily, when the mandrel 628 is fully driven into the earth, at least a portion of the wind tube 670 remains within the mandrel 628.

The embodiment described in FIGS. 11–13 does not require the insertion assembly 624 to support a mast above the location 642 at which the wick drain material 630 is to be inserted. This arrangement also allows the crane 622 to assist in pulling the mandrel 628 out of the ground by lifting the cables 638 and 640. Because the mandrel 628 is not enclosed within a mast or housing, the upper end 678 of the mandrel 628 is exposed and the operator of the system 620 knows how deep the mandrel 628 extends into the ground.

Figure 14:
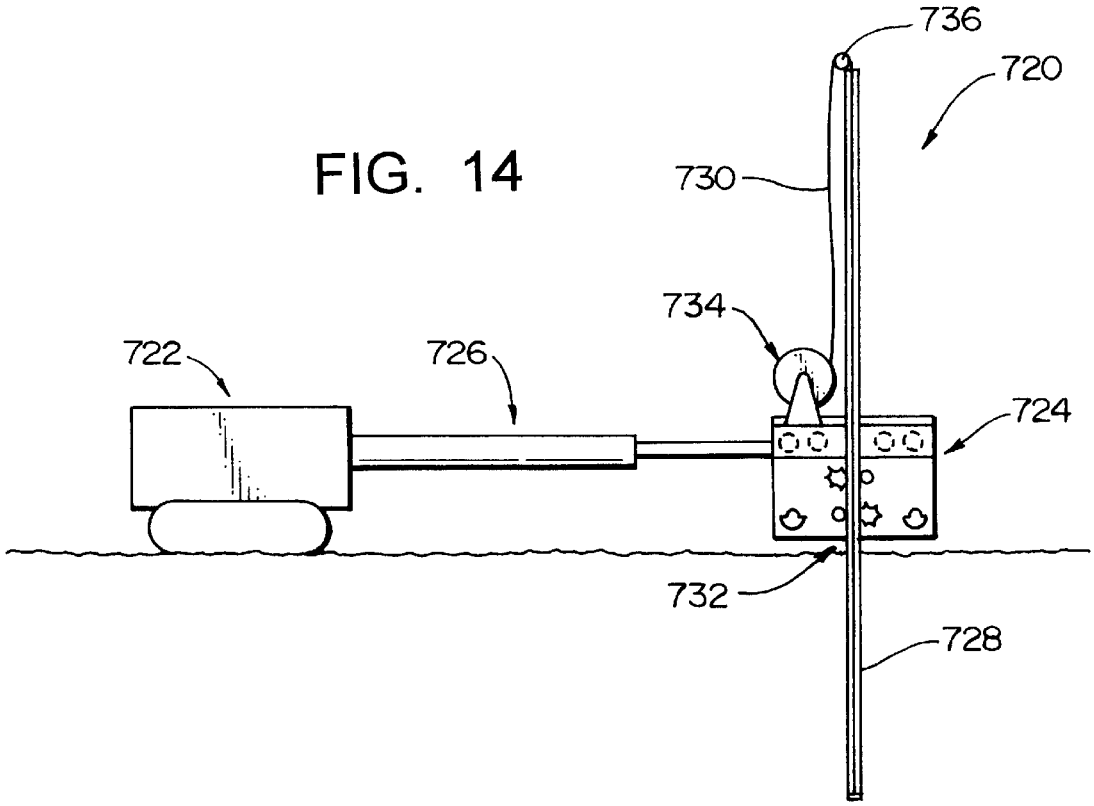
FIG. 14 is a somewhat schematic side elevation view of still another exemplary elongate member insertion/removal system that is constructed in accordance with the principles of the present invention.

Referring now to FIG. 14 depicted therein is yet another exemplary system 720 for inserting wick drain material into the ground. The system 720 comprises a movable truck 722, an insertion assembly 724, a spotter assembly 726, a mandrel 728, and wick drain material 730. The system 720 is similar to the system 620 described above but does not employ a crane with a boom to support the insertion assembly 724 above a desired location 732. Instead, the insertion assembly 724 is entirely supported by the spotter 726. In this case, a roll 734 of the wick drain material 730 is mounted on the insertion assembly 724 and is fed over a roller 736 on the mandrel 728 and then down through the mandrel 728. Expect for the fact that the roll 734 of wick drain material 730 is mounted on the insertion assembly 724, the insertion assembly 724 is constructed and operates in the same basic manner as the insertion assembly 624 described above.

The system 720 is highly appropriate for situations in which the wick drain material need not be inserted to a great depth. If the wick drain material is to inserted to a great depth, the system 620 described above is preferable.

In either case, the location at which the wick drain material is to be inserted need not be sufficiently stable to support the insertion assembly and mandrel. To the contrary, the crane 622 and/or truck 722 may be arranged some distance away from the location at which the wick drain is to be inserted.

6. Indicator System

Figure 15A:
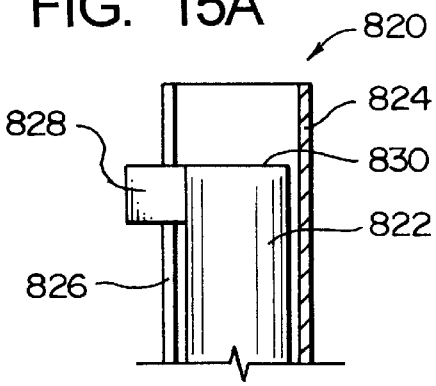
FIGS. 15A and 15B are front elevation section and side elevation views, respectively, depicting an indicator system of the present invention.
Figure 15B:
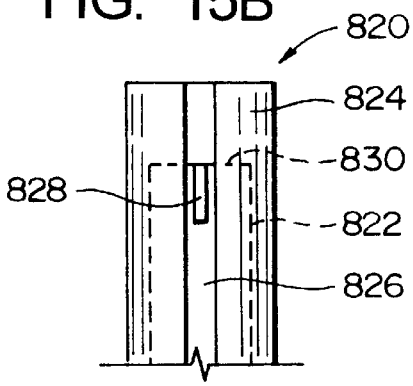

Referring to FIGS. 15A and 15B, depicted at 820 therein is an indicator system that may be used with any of the embodiments above having a vertically extending mast that encloses the mandrel as the mandrel is driven into the ground.

In particular, in FIGS. 15A and 15B, the mandrel is depicted at 822 and the mast is depicted at 824. A window 826 is formed along substantially the entire length of the mast 824, and an indicator 828 is formed on an upper end 830 of the mandrel 822. The exemplary window 826 is in the form of a continuous slot that extends substantially along the entire length of the mast 824. The indicator 828 is preferably painted a highly visible color.

As the mandrel 822 is driven into the earth, the upper end 830 thereof moves downward. If the mast is entirely closed, the mandrel upper end 830 is not visible and the operator does not know how far the mandrel 822 has been driven into the earth. With the exemplary system 820, the exemplary indicator 828 is a projection that extends out of the mast 824 through the window 826 and is thus clearly visible to the operator. The operator thus has a clear visual indication of how far the mandrel 822 has been driven into the earth.

The indicator 828 need not be a projection, however. The mandrel upper end 830 will be visible through the slot 826 without a projection or being painted and thus may serve the function of the indicator 828. Painting the mandrel upper end 830 a highly visible color will help the operator to see this upper end through the slot 826. And if the indicator 828 does not extend out of the mast 824, the window 826 need not be a continuous slot, but may instead be formed by a series of holes that allow the operator to view the mandrel upper end 830 and thus the indicator 828.

From the foregoing, it should be clear that the present invention may be embodied in forms other than those described above. The above-described systems are therefore to be considered in all respects illustrative and not restrictive, the scope of the invention being indicated by the appended claims rather than the foregoing description. All changes that come within the meaning and scope of the claims are intended to be embraced therein.

What is claimed is:

1. A drive system for inserting into the ground an elongate member defining a member axis, comprising:

a support plate;

a support system that engages the ground and supports the support plate at a substantially fixed height above a desired location;

an insertion housing defining an opening through which the elongate member passes as the elongate member is driven into the ground;

a suppression system operatively connected between the support plate and the insertion housing to support the insertion housing above the desired location and resiliently oppose relative movement between the support plate and the insertion housing;

at least one drive gear mounted to the insertion housing, where the drive gear engages the elongate member such that rotation of the drive gear displaces the elongate member along the member axis;

a vibratory system for creating vibratory forces, where the vibratory system is substantially symmetrically arranged within the insertion housing relative to the member axis such that vibratory forces created thereby are transmitted to the elongate member through the at least one drive gear substantially along the member axis; wherein rotation of the drive gear crowds the elongate member into the ground, operation of the vibratory system vibrates the elongate member into the ground, and rotation of the drive gear and operation of the vibratory system together crowds and vibrates the elongate member into the ground.

2. A drive system as recited in claim 1, in which:

a drive rack is formed on opposing surfaces of the elongate member; and the at least one drive gear engages the drive rack.

3. A drive system as recited in claim 1, further comprising at least one drive roller that engages the elongate member in opposition to the at least one drive gear.

4. A drive system as recited in claim 1, in which the vibratory system comprises first and second eccentric weights substantially symmetrically arranged on either side of the elongate member.

5. A drive system as recited in claim 1, in which the support system comprises:

a support base that engages the ground; and a spotter assembly operatively connected between the support base and the support plate.

6. A drive system as recited in claim 5, in which the support system further comprises a boom operatively connected between the support base and the support plate.

7. A drive system as recited in claim 1, in which the support system comprises:

a support base that engages the ground; and a boom operatively connected between the support base and the support plate.

8. A drive system as recited in claim 1, in which:

the support system comprises a support base that engages the ground; and the elongate member is a mandrel for carrying wick drain material into the ground, where a supply of wick drain material is supported by the support base.

9. A drive system as recited in claim 1, in which the elongate member is a mandrel for carrying wick drain material into the ground, where a supply of wick drain material is supported by the support plate.

10. A drive system as recited in claim 1, in which the elongate member is a mandrel for carrying wick drain material into the ground, the drive system further comprising a wind sleeve that protects at least a portion of the wick drain material above the elongate member.

11. A drive system as recited in claim 1, in which the support plate is arranged above the at least one drive gear.

12. A drive system as recited in claim 1, in which:

the elongate member is a mandrel for carrying wick drain material into the ground; and the drive system further comprises a mast extending from the support plate above the insertion housing for supporting the mandrel above the desired location; wherein at least one opening is formed in the mast to allow visual location of the mandrel within the mast.

13. A drive system for inserting into the ground a mandrel for carrying wick drain material, comprising:

a support plate;

a support system that engages the ground and supports the support plate at a substantially fixed height above a desired location;

an insertion housing;

a suppression system operatively connected between the support plate and the insertion housing to support the insertion housing above the desired location and resiliently oppose relative movement between the support plate and the insertion housing;

at least one drive gear mounted to the insertion housing, where the drive gear engages the mandrel such that rotation of the drive gear displaces the mandrel along its longitudinal axis;

a vibratory system for creating vibratory forces, where the vibratory system is mounted to the insertion housing such that the vibratory forces are transmitted to the mandrel through the at least one drive gear;

a mast extending from the support plate above the insertion housing for supporting the mandrel above the desired location, where at least one opening is formed in the mast to allow visual location of the mandrel within the mast; wherein rotation of the drive gear crowds the mandrel into the ground, operation of the vibratory system vibrates the mandrel into the ground, and rotation of the drive gear and operation of the vibratory system together crowds and vibrates the mandrel into the ground.

14. A drive system as recited in claim 13, in which a projection is formed on an upper end of the mandrel, where the projection extends through the opening formed in the housing to allow visual detection of the upper end of the mandrel within the mast.

15. A drive system as recited in claim 13, in which an upper end of the mandrel is painted to enhance visual detection of the upper end of the mandrel within the mast.

16. A drive system as recited in claim 13, in which the projection is painted to enhance visual detection of the upper end of the mandrel within the mast.

* * * * *